US005135222A

United States Patent [19]

Spector

[11] Patent Number: 5,135,222

[45] Date of Patent: Aug. 4, 1992

[54] MULTI-MODE PLAYBALL

[76] Inventor: Donald Spector, 380 Mountain Rd., Union City, N.J. 07087

[21] Appl. No.: 793,190

[22] Filed: Nov. 18, 1991

Related U.S. Application Data

[63] Continuation-in-part of Ser. No. 743,279, Aug. 9, 1991, which is a continuation-in-part of Ser. No. 345,405, May 1, 1989, which is a continuation-in-part of Ser. No. 205,477, Jun. 13, 1988, Pat. No. 4,834,382.

[51] Int. Cl.[5] ..... A63B 39/06; A63B 41/02; A63B 41/10

[52] U.S. Cl. ..... 273/58 C; 383/76; 383/112; 383/111; 383/902; 150/106; 150/154; 150/163; 206/315.1; 206/822; 206/577; 206/579; 273/DIG. 20; 273/65 A; 273/65 B; 273/65 ED; 273/58 BA; 446/220

[58] Field of Search ..... 273/58 C, DIG. 20, 65 B, 273/65 A, 65 ED, 65 F, 58 B, 58 BA; 383/76, 111, 112, 901, 902; 46/220; 206/315.2, 315.9, 286, 287, 577, 579; 150/106, 107, 110, 113, 116, 127, 154, 163

[56] References Cited

U.S. PATENT DOCUMENTS

| | | | |
|---|---|---|---|
| 729,473 | 5/1903 | Wilson | 273/58 C |
| 1,536,816 | 5/1925 | Sale | 446/220 X |
| 2,598,334 | 5/1952 | Ahlburg | 383/76 X |
| 3,285,307 | 11/1966 | Dormaier | 383/76 X |
| 3,483,907 | 12/1969 | Corridon | 383/76 |
| 4,022,476 | 5/1977 | Barton | 273/58 C X |
| 4,658,989 | 4/1987 | Bonerb | 383/112 X |

FOREIGN PATENT DOCUMENTS

| | | | |
|---|---|---|---|
| 3355 | 4/1900 | United Kingdom | 383/901 |

*Primary Examiner*—George J. Marlo
*Attorney, Agent, or Firm*—Michael Ebert

[57] ABSTRACT

A multi-mode playball whose components are a shaped casing of flexible material having an opening therein that is closable by a drawstring whose end portions, when the string is drawn, then extend from the closed opening, and a toy balloon, which in its uninflated state is insertable into the casing and when then inflated stretches to conform to the shape of the casing to create a pneumatic playball. The playball is operable in any one of three modes, the first being a ball mode in which the end portions of the drawn string are inserted into the casing before the balloon is inflated and the resultant pneumatic ball can then be thrown, kicked and bounced. In the second or bop mode, the pneumatic ball is tethered by the end portion of the drawstring whereby the ball can then be punched back and forth. In the third or carry case mode, inserted into the casing thorugh the opening therein are one or more small articles, after which the string is drawn to close the opening and the end portion then serves as a handle for the loaded case.

7 Claims, 3 Drawing Sheets

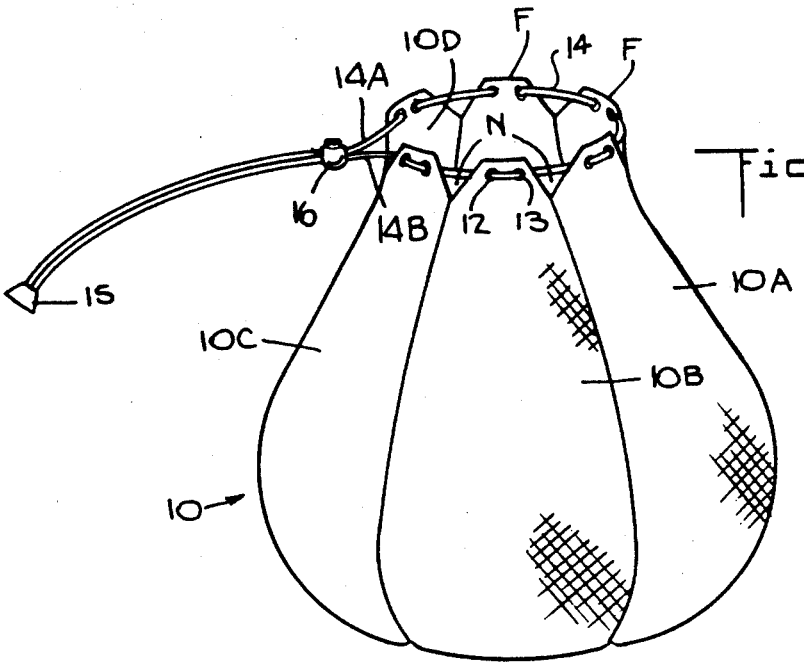
Fig. 1.
Fig. 4.
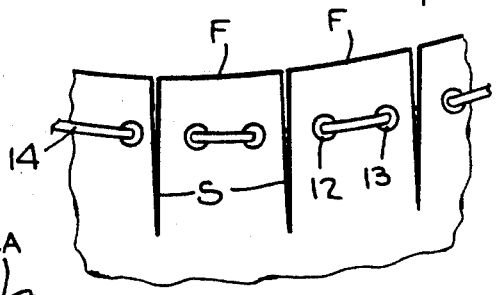
Fig. 2.
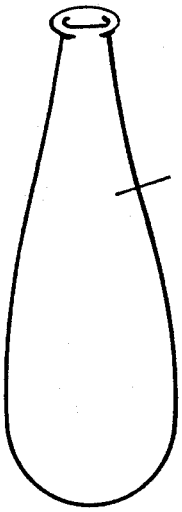
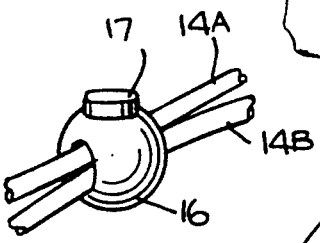
Fig. 3.
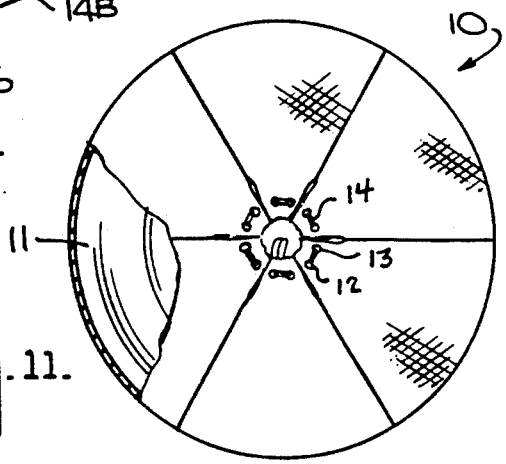
Fig. 11.

MULTI-MODE PLAYBALL

RELATED APPLICATION

This application is a continuation-in-part of my copending application Ser. No. 743,279, filed Aug. 9, 1991, entitled "Variable-Weight Play ball," which in turn is a continuation-in-part of my copending application Ser. No. 345,405, filed May 1, 1989, entitled "Pneumatic Bolster," this being a continuation-in-part of a still earlier patent application Ser. No. 205,477, filed Jun. 13, 1988, entitled "Inflatable Play Ball (now U.S. Pat. No. 4,834,382). The entire disclosures of these prior applications are incorporated herein by reference.

BACKGROUND OF INVENTION

1. Field of Invention

This invention relates generally to pneumatic playballs, and more particularly to a playball operable in any one of three modes, in one of which the ball can be thrown, kicked and bounced, in the second of which the ball is tethered and can then be punched back and forth, and in the third of which the ball casing acts as a carry case for small articles.

2. Status of Prior Art

A standard oval-shaped football is made of an inflatable, high strength inner bladder and a outer casing formed of heavy leather, rubber or flexible plastic material. The bladder is provided with a valve so that it can be inflated with air, the valve automatically closing to retain the air in the bladder. Made in a similar fashion are spherical soccer balls, volley balls and basketballs. In these standard balls, the bladder is molded to assume, when inflated, the same shape as the outer casing.

In the process of play, standard sports balls of the pneumatic type are tossed, kicked and bounced, the balls being capable of withstanding very rough handling. While such balls are not regarded by adults as unduly heavy, they represent an intolerable load to a young child. Moreover, a standard inflatable athletic ball tends to produce a "hand sting." This effect arises when the ball which has a hard casing is caught by the bare hands while moving at high velocity.

While small children are attracted to conventional athletic balls and enjoy watching adults play soccer, football and other ball games, in the hands of a small child these athletic balls are heavy and dangerous.

My prior U.S. Pat. No. 4,834,382, discloses a pneumatic playball that has the configuration and appearance of a standard pneumatic athletic ball such as a football or basketball, yet is much lighter, and therefore when in the hands of young children, it is far safer to play with. And despite its light weight, the ball is exceptionally strong and can withstand rough handling.

This patented pneumatic play ball includes an outer casing of non-stretchable fabric material having a closable opening therein, the configuration of the casing depending on the nature of the ball. The casing encases an ordinary balloon whose stretchable rubber skin, when unconfined, is capable of being inflated to assume a generally globular form, the balloon having an air-passage neck or stem making mouth inflation possible. In its uninflated state, the balloon is inserted into the casing through the opening, the neck then projecting out of the opening.

After the confined balloon is inflated by blowing air through its neck to cause the skin of the balloon to stretch and conform to the inner surface of the casing, and to assume the same configuration, the stem is knotted to seal the balloon. The knotted stem is pushed under the opening which is then closed, whereby no portion of the encased balloon can be extruded from the casing when the ball is bounced or kicked or otherwise subjected to external forces.

Balloons are commercially available in large as well as in small sizes, so that it becomes possible to create a pneumatic ball of the type disclosed in my prior patent in, say, a 14-inch diameter size or larger, this size being greater than that of the standard basketball or soccer ball. And in such large ball sizes, the fabric casing must be dimensioned accordingly. The present invention exploits large-size outer casings, so as to render the ball operable in more than one mode.

A significant advantage of a playball of the type disclosed in my prior patent is that it can be collapsed when not in use. When, therefore, a child takes this ball to the beach or to a play area, the playball in its collapsed state takes little room when placed in a carry case loaded with clothing, toys and other items being brought to the play area by the child.

The less a child is called upon to carry, the lighter is the load imposed on him. Also, since children are often careless, the more articles a child takes to a play area, the greater the likelihood that he will lose one or more of these items before the day is out.

If, therefore, a child is given a conventional open-sack type of carry case for transporting a playball and other items to a play area, not only does one run the risk that some of these items will fall out of the case without the child being aware of this happening, but he may also forget where he put this carry case on the beach or in the play area. Accordingly, the risk of loss can be reduced by cutting down the number of items borne by the child, and particularly by doing away with the need for a separate carry case.

SUMMARY OF INVENTION

In view of the foregoing, the main object of this invention is to provide a multi-mode, balloon-type playball whose shaped casing of flexible material has a relatively large opening therein that is closable by a drawstring, the end portions of which when the string is drawn to close the opening then extending from the casing, whereby in a ball mode of operation, the end portions of the drawn string are buried in the casing and the ball can then be thrown, kicked and bounced, while in a bop mode of operation, the end portions of the drawn string act to tether the ball so that it can be punched back and forth by a player.

More particularly, an object of the invention is to provide a playball of the above type which also is capable of operating in a carry case mode in which the casing then functions to store small articles and the end portions of the drawn string then function as a handle for the case.

A significant advantage of the invention is that it dispenses with the need for a separate carry case to transport the playball and other items to a beach or other play area, for the playball itself serves as a carry case, and in this mode the drawstring acts to close the carry case to prevent the loss of items therefrom.

Also an object of the invention is to provide a multi-mode playball which is inexpensive to manufacture and which operates efficiently in each of its three modes.

Briefly stated, in a multi-mode playball according to the invention, there is provided a shaped outer casing of flexible material adapted to encase an inflatable toy balloon, the casing having a relatively large opening bordered by a circular array of V-shaped notches defining a series of flaps. Threaded through eyelets in the flaps is a drawstring whose end portions which extend from the opening pass through and are slidable with respect to a releasable clasp. When the clasp is released to permit a user to pull the drawstring and thereby close the opening, the drawn string acts to transform the V-shaped notches into narrow slits.

To render the ball operative in a ball mode, the casing opening is closed by the drawstring, and the end portions of the drawn string are then pushed into the casing through one of the slits. Then an uninflated balloon is inserted into the casing through another slit, with its neck projecting therefrom for mouth inflation to cause the skin of the balloon to stretch and conform to the shape of the casing, after which the neck is tied into a knot which is pushed into the casing, so that the resultant pneumatic ball can be thrown, kicked and bounced.

To render the playball operative in the bop mode, the procedure is the same as in the ball mode, except that the end portions of the string serve to tether the ball which can now be punched back and forth.

To render the playball operative in the carry case mode, items to be stored and transported are loaded into the casing through its opening, after which the string is drawn to close the opening, the end portions of the drawn string then serving as the handle for the loaded case.

BRIEF DESCRIPTION OF DRAWINGS

For a better understanding of the invention as well as other objects and further features thereof, reference is made to the following detailed description to be read in conjunction with the accompanying drawings, wherein;

FIG. 1 is a perspective view of the casing included in a multi-mode playball in accordance with the invention;

FIG. 2 is a perspective view of a rubber balloon which is used in conjunction with the casing to create a pneumatic ball;

FIG. 3 illustrates the releasable clasp on the drawstring;

FIG. 4 shows how the opening of the casing is closed;

FIG. 11 is a perspective view of the resultant pneumatic playball operable in the ball mode;

DESCRIPTION OF INVENTION

Figure 5:
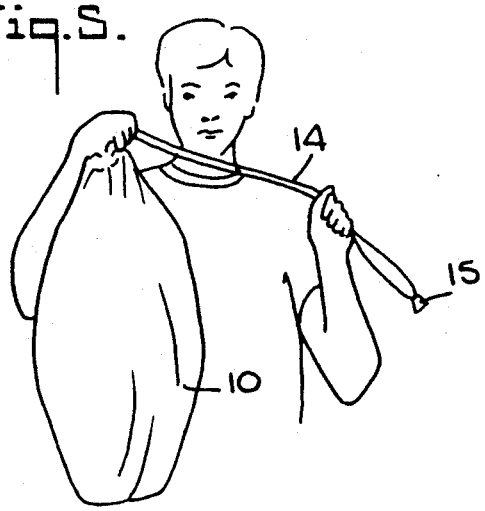
FIG. 5 illustrates the first step A in a procedure for creating a playball in accordance with the invention to be operated in a ball mode.

Referring now to FIG. 1, this illustrates the unoccupied casing 10 of a multi-mode play ball in accordance with the invention. In the embodiment shown, casing 10 is spherical in shape when erected and has a diameter which may be much greater than that of a regulation basketball or soccer ball, for the casing must also be capable of functioning as a carry case.

FIG. 2 illustrates the toy rubber balloon 11 whose size must be appropriate to the size of the casing, so that when the balloon is inflated within the casing and its skin stretches to conform to the shape of the casing, when so stretched the balloon will be well below its bursting point. Thus a rubber balloon intended for a casing having a 15-inch diameter must be larger than one intended for a casing having a 9-inch diameter.

Casing 10 is created by interfitting contoured pieces 10A, 10B, 10C, 10D, etc., of non-stretchable fabric sheeting sewn together by filamentary thread lines which are not visible on the outer surface of the casing. If the fabric is made of thermoplastic synthetic fibers, the pieces may be ultrasonically seamed together to render them watertight at the seams. A preferred fabric for this purpose is parachute cloth, which is a high-strength, light-weight, closely woven fabric made of nylon fibers. Other types of non-stretchable fabrics, such as Gore-tex, may be used for the casing material.

Spherical casing 10 is provided at one of its poles with a relatively large opening bordered by a circular array of equi-spaced triangular notches N which define an endless series of flaps F. Each flap is provided adjacent its straight upper edge with a pair of eyelets 12 and 13.

Threaded through the eyelets in the flaps F is a long drawstring 14 whose end portions 14A and 14B extend from the opening to a degree that depends on the extent to which the string is drawn to close the opening.

End portions 14A and 14B of drawstring 14 terminate in a common tab 15 of soft fabric to tie these portions together. Slidable along the end portions between tab 15 and the casing opening is a releasable clasp 16. As best seen in FIG. 3, clasp 16 is provided with a button 17 that is spring-biased to urge the button to its normal position where the end portions which go through a hole in the button are then pressed against the interior cavity wall of the clasp to prevent movement of the end portions relative to the clasp. When, however, the button is depressed by an operator, this pressure is released and the clasp is then slidable relative to the end portions.

When drawstring 14, which is threaded through flaps F of the casing, is drawn tight to close the opening, this causes flaps F to draw together and thereby transform the V-shaped notches N into narrow slits S, as shown in FIG. 4. Hence when closing the opening, the operator holds the clasp in one hand, and releases the clasp with a finger of this hand, while with his other hand he pulls the drawstring end portions to close the opening, the clasp being slid to a position adjacent the closed opening at which its acts to maintain the opening in the closed state. And to reopen the opening, the clasp is released and slid toward the terminal tab 14, and the flaps which are then free can be pulled apart to enlarge the opening to its maximum size.

The Ball Mode

Figure 6:
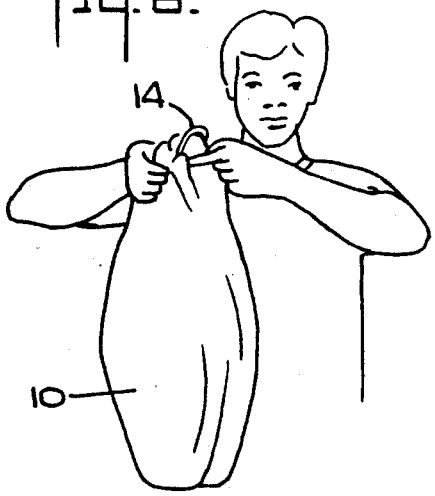
FIG. 6 illustrates the second step B.

To render this playball operative in the ball mode in which the ball has exceptional bounce characteristics because of its high internal pressure whereby the ball can then be thrown, kicked or bounced in the manner of the pneumatic ball disclosed in my prior patent, the following procedure is followed:

In the first step A, as shown in FIG. 5, the end portions of string 14 are pulled tight to close the opening of casing 10, the clasp 16 then being adjacent the closed opening. The next step B, as shown in FIG. 6, is to insert the end portions of the drawn string 14 into the closed casing through a slit S (see FIG. 4) in the casing, so that the end portions are now loosely buried within the closed casing.

Figure 7:
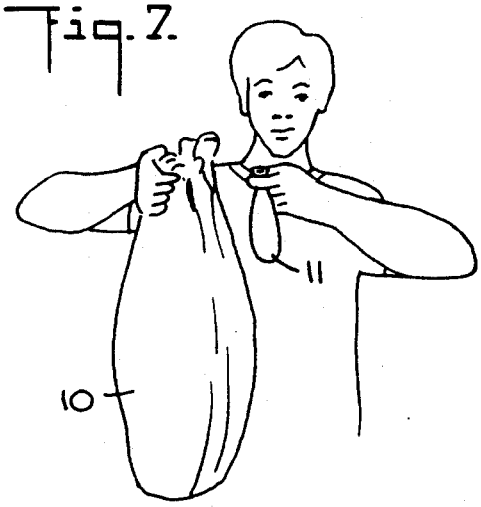
FIG. 7 illustrates the third step C.
Figure 8:
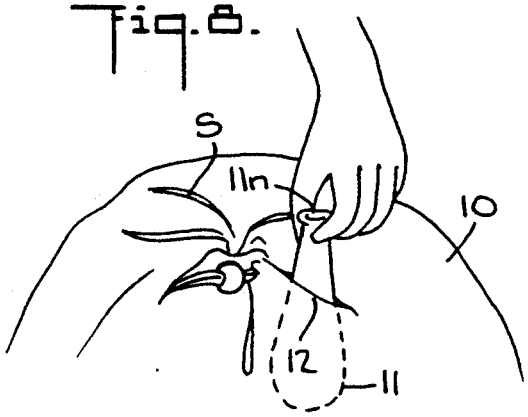
FIG. 8 illustrates the fourth step D.

The in the next step C, as shown in FIG. 7, the operator, while holding casing 10 in one hand, takes the balloon 11 in his other hand, and in step D, as shown in FIG. 8, he inserts the uninflated balloon 11 through a slit S in the casing so that its neck then projects out of the slit for mouth inflation.

Figure 9:
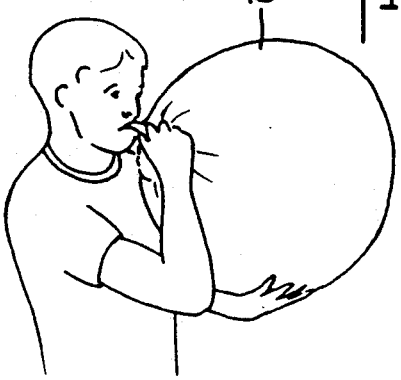
FIG. 9 illustrates the fifth step E.

The operator in step E, shown in FIG. 9, then proceeds to inflate the balloon so that its skin stretches to engage the inner surface of casing 10 and to conform thereto.

Figure 10:
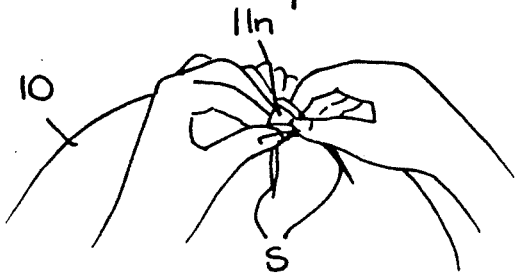
FIG. 10 illustrates the sixth and final step F.

Finally, in step F, as shown in FIG. 10, the operator ties the neck 11 of the balloon and pushes the resultant knot into casing 10 through slit S so it lies under the slit and does not project from the casing.

Thus both the knot in the neck of the balloon and the drawstring end portions are disposed within the casing and are pressed against its inner surface by the balloon pressure. The resultant pneumatic ball, as shown in FIG. 11, is then in its ball mode.

The Bop Mode

Figure 12:
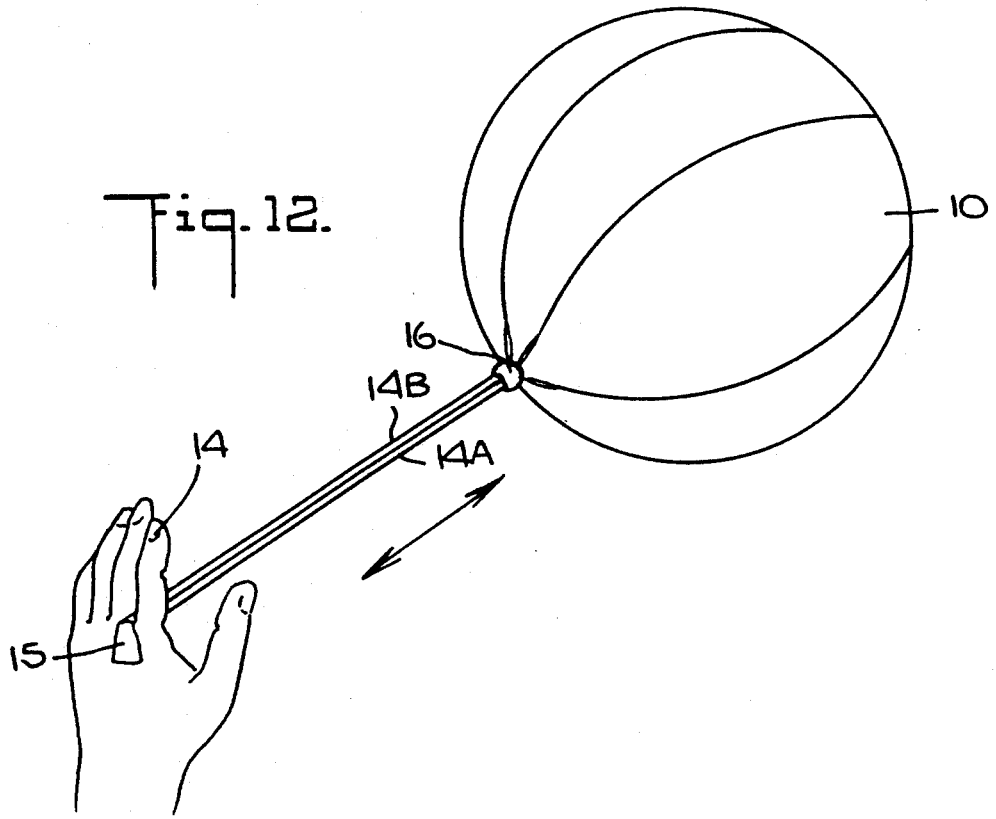
FIG. 12 illustrates the same ball when operating in the bop mode.

To render the ball operative in the bop mode, the procedure used for this purpose is the same as in the ball mode, except that end portions 14A and 14B of the drawstring are not stuffed into casing 10 but extend therefrom, thereby providing a tethered ball, as shown in FIG. 12. In this way, a player holding the ball by its tether in one hand can then with his other hand punch the ball back and forth.

The Carry Case Mode

When one wishes to use the ball as a carry case, then the balloon therein is deflated and removed, and the button on clasp 16 is depressed to release the drawstring.

Figure 13:
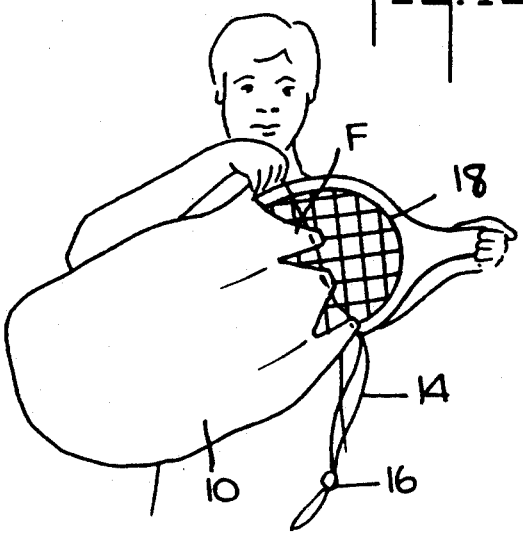
FIG. 13 illustrates the manner in which the casing of the ball, when operating in a carry case mode, is loaded with small articles.
Figure 14:
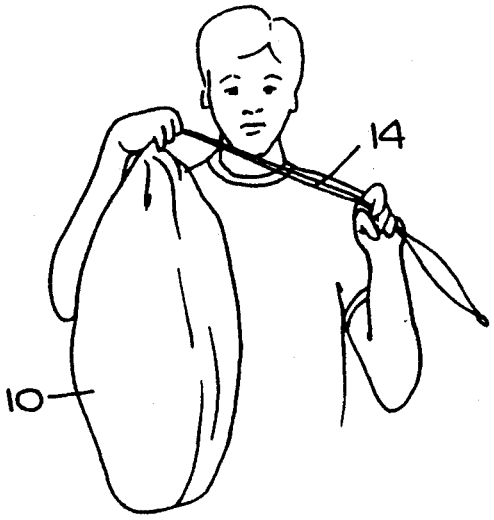
FIG. 14 shows the carry case being handled.

Thus, as shown in FIG. 13, the flaps F at the opening of casing 10 are pulled apart to enlarge the opening so that one can now load small articles, such as paddle 18, into the casing which now serves as a carry case. Then, as shown in FIG. 14, the drawstring is again drawn to close the opening of the casing so that the articles are now imprisoned therein and cannot fall out.

Now the end portions of drawstring 14 serves as a handle for the carry case which can be carried over the shoulder or in any other convenient manner.

While there has been shown and described a preferred embodiment of a multi-mode playball in accordance with the invention, it will be appreciated that many changes and modifications may be made therein without, however, departing from the essential spirit thereof.

Thus the casing may be shaped as a cylindrical bolster so that when occupied by an inflated balloon it can then in one mode function as a sleeping pillow, and when the balloon is removed and the casing loaded with small articles, it can serve as a carry case. Or the casing may be given a football shape; hence in the carry case mode the case is football shaped.

I claim:

1. A multi-mode playball comprising:

(a) a shaped casing of flexible material having a relatively large opening therein and means for closing said opening by an included drawstring whose end portions, when the string is drawn and said opening is closed, then extend a substantial distance away from the closed opening; and (b) a toy balloon which is insertable into the casing and which when inflated stretches to conform to the shape of the casing to create a pneumatic playball, whereby in a ball mode of operation, the end portions of the drawstring are buried in the casing between the inflated balloon and the inner surface of the casing to provide a ball that can be thrown, bounced and kicked, and in a bop mode of operation in which the ball is tethered by the end portions of the drawstring extending from the closed opening, the ball may then be punched back and forth in the manner of a punching bag.

2. A playball as set forth in claim 1, wherein the casing is large enough to accommodate small articles loaded therein, whereby when the drawstring is drawn to close the opening, the ball is then operative in a carry case mode in which the end portions act as a handle for the case.

3. A playball as set forth in claim 1, wherein said casing when erected is spherical in shape.

4. A playball as set forth in claim 3, wherein said casing is formed of contoured pieces of fabric which are seamed together.

5. A playball as set forth in claim 1, wherein said opening in the casing is bordered by a circular series of V-shaped notches that define a series of flaps having eyelets therein through which said drawstring is threaded, whereby when the drawstring is drawn to close the opening, the notches are then brought closer together to form slits.

6. A playball as set forth in claim 5, wherein said end portions terminate in a common fabric tab.

7. A playball as set forth in claim 6, further including a releasable clasp through which said end portions pass, said clasp being slidable to a position adjacent said closed opening to maintain the opening in its closed state until the clasp is released.

* * * * *